US011933289B2

(12) United States Patent
Ike

(10) Patent No.: US 11,933,289 B2
(45) Date of Patent: Mar. 19, 2024

(54) SELECTIVE FLUID PUMPING SYSTEM

(71) Applicant: KABUSHIKI KAISHA YASKAWA DENKI, Kitakyushu (JP)

(72) Inventor: Hideaki Ike, Fukuoka (JP)

( * ) Notice: Subject to any disclaimer, the term of this patent is extended or adjusted under 35 U.S.C. 154(b) by 181 days.

(21) Appl. No.: 17/356,518

(22) Filed: Jun. 24, 2021

(65) Prior Publication Data

US 2021/0317826 A1 Oct. 14, 2021

Related U.S. Application Data

(63) Continuation of application No. PCT/JP2018/048569, filed on Dec. 28, 2018.

(51) Int. Cl.

| | |
|---|---|
| ***F04B 49/00*** | (2006.01) |
| ***F04B 17/03*** | (2006.01) |
| ***F04B 23/04*** | (2006.01) |
| ***F04B 49/02*** | (2006.01) |
| ***F04B 49/06*** | (2006.01) |
| ***F04B 49/20*** | (2006.01) |
| ***F04B 51/00*** | (2006.01) |

(52) U.S. Cl.

CPC ..... *F04B 49/007* (2013.01); *F04B 17/03* (2013.01); *F04B 23/04* (2013.01); *F04B 49/022* (2013.01); *F04B 49/065* (2013.01); *F04B 49/20* (2013.01); *F04B 51/00* (2013.01); *F04B 2203/0201* (2013.01); *F04B 2203/0401* (2013.01); *F04B 2205/05* (2013.01)

(58) Field of Classification Search

CPC ..... F04B 17/03; F04B 23/04; F04B 49/007; F04B 49/022; F04B 49/06; F04B 49/065; F04B 49/20; F04B 51/00; F04B 2203/0201; F04B 2203/0401; F04B 2205/05

See application file for complete search history.

(56) References Cited

U.S. PATENT DOCUMENTS

| | | |
|---|---|---|
| 5,287,875 A | 2/1994 | Otani |
| 6,260,004 B1 | 7/2001 | Hays et al. |

(Continued)

FOREIGN PATENT DOCUMENTS

| | | |
|---|---|---|
| CN | 1497181 | 5/2004 |
| CN | 104662377 | 5/2015 |

(Continued)

OTHER PUBLICATIONS

Office Action issued in Japanese Patent Application No. P2020-562292, dated Feb. 7, 2023 (with English partial translation).

(Continued)

*Primary Examiner* — Charles G Freay

(74) *Attorney, Agent, or Firm* — SOEI PATENT & LAW FIRM

(57) ABSTRACT

A control system may include circuitry configured to: a deterioration level estimation unit configured to estimate deterioration levels of pumping devices based on information about driving forces of the pumping devices; a selection unit configured to select a pumping device from the pumping devices based on a comparison of the estimated deterioration levels estimated by the deterioration level estimation unit; and a pumping control unit configured to control the selected pumping device selected by the selection unit to pump fluid.

15 Claims, 6 Drawing Sheets

(56) References Cited

U.S. PATENT DOCUMENTS

| | | | | |
|---|---|---|---|---|
| 2003/0133808 | A1 | 7/2003 | Sabini et al. | |
| 2004/0064212 | A1* | 4/2004 | Samata | F04C 28/28 702/183 |
| 2010/0014987 | A1* | 1/2010 | Garcia | F04B 49/06 417/2 |
| 2015/0252814 | A1 | 9/2015 | Nakahara et al. | |

FOREIGN PATENT DOCUMENTS

| | | |
|---|---|---|
| JP | H4-194396 | 7/1992 |
| JP | H9-126144 | 5/1997 |
| JP | 2004-124765 | 4/2004 |
| JP | 2005-147081 | 6/2005 |
| JP | 2006-144612 | 6/2006 |
| JP | 2010-288352 | 12/2010 |
| JP | 2013-124565 | 6/2013 |
| JP | 2017-011872 | 1/2017 |
| JP | 2017-160803 | 9/2017 |
| WO | 2009/147426 | 12/2009 |
| WO | 2014/050195 | 4/2014 |
| WO | 2015/066219 | 5/2015 |

OTHER PUBLICATIONS

Office Action issued in Chinese Patent Application No. 201880100536.7, dated Sep. 19, 2022 (with English partial translation).

Office Action issued in Chinese Patent Application No. 201880100536.7, dated Apr. 13, 2023 (with English partial translation).

Extended Search Report in corresponding European Application No. 18944814.5 dated May 27, 2022.

International Search Report dated Apr. 9, 2019 for PCT/JP2018/048569.

International Preliminary Report on Patentability with Written Opinion dated Jul. 8, 2021 for PCT/JP2018/048569.

Office Action issued in Chinese Patent Application No. 201880100536.7, dated Jul. 21, 2023 (with English partial translation).

Office Action issued in Japanese Patent Application No. P2020-562292 dated Jul. 25, 2023 (with English partial translation).

Official Notification issued in Japanese Patent Application No. P2020-562292, dated Jul. 25, 2023 (with English partial translation).

* cited by examiner

SELECTIVE FLUID PUMPING SYSTEM

CROSS-REFERENCE TO RELATED APPLICATIONS

This application is a continuation application of PCT Application No. PCT/JP2018/048569, filed on Dec. 28, 2018, the entire contents of which are incorporated herein by reference.

BACKGROUND

1. Field

The present disclosure relates to a fluid pumping system, a power conversion system, a power conversion apparatus, and a fluid pumping method.

2. Description of the Related Art

Japanese Unexamined Patent Publication No. Hei 9(1997)-126144 discloses a process for operating a variable speed feed water pump, including: additionally supplying a first pump when an operation speed of the second pump continues to be an allowable maximum operation speed for a predetermined time or more; and stopping the operation of the second pump when a state in which a discharge amount of the second pump is small continues for a predetermined time or more.

SUMMARY

Disclosed herein is an example control system including circuitry configured to: estimate deterioration levels of pumping devices based on information about driving forces of the pumping devices; select a pumping device from the pumping devices based on a comparison of the estimated deterioration levels; and control the selected pumping device to pump fluid.

Additionally, an example fluid pumping system is disclosed herein. The fluid pumping system includes: the control system; and the pumping devices configured to be controlled by the control system.

Additionally, an example fluid pumping method is disclosed herein. The fluid pumping method includes: estimating a deterioration levels of pumping devices based on information about driving forces of the pumping devices; selecting a pumping device from the pumping devices based on a comparison of the estimated deterioration levels; and controlling the selected pumping device to pump fluid.

DETAILED DESCRIPTION

Figure 1:
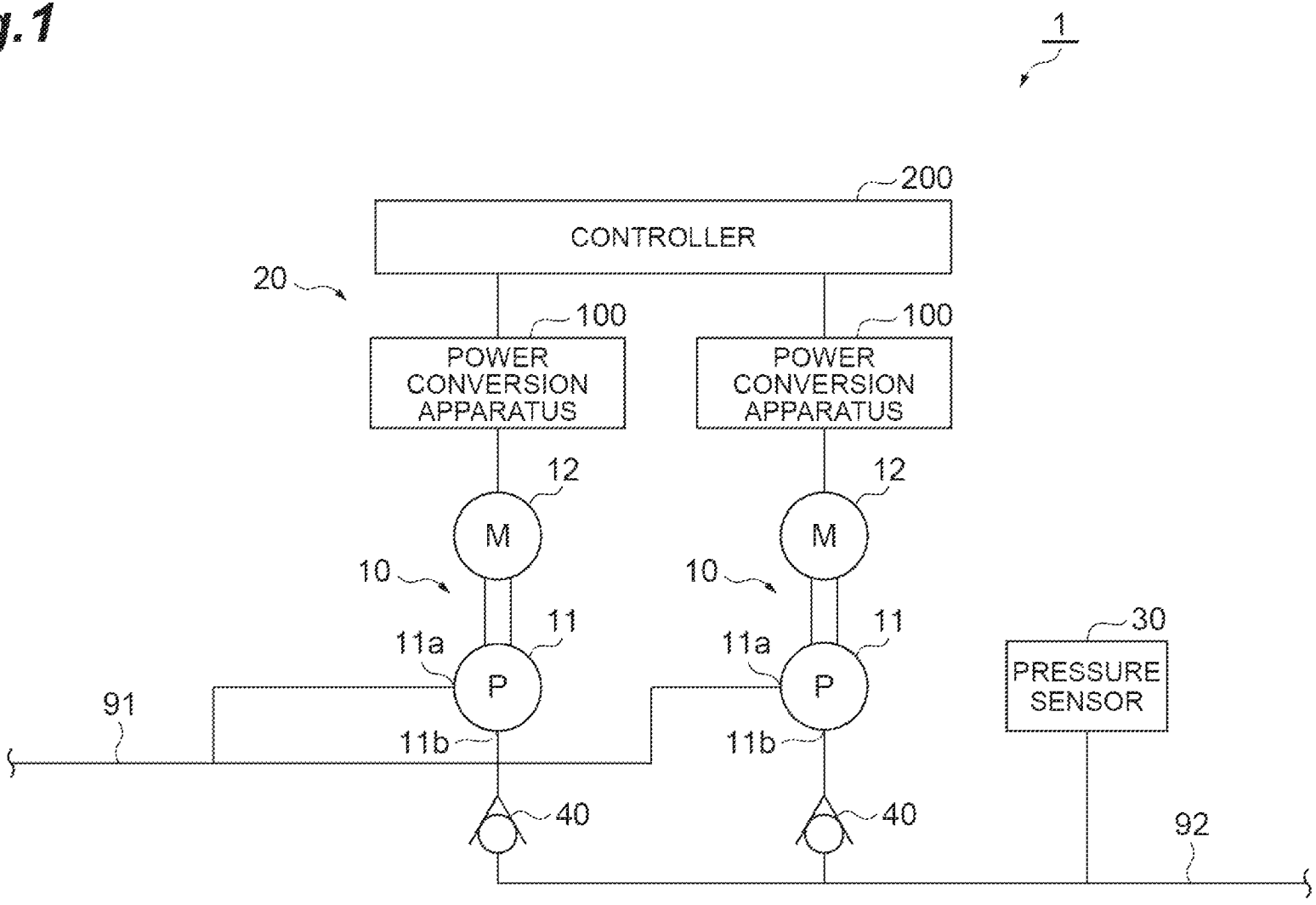
FIG. 1 is a schematic diagram illustrating a schematic configuration of a fluid pumping system.

Hereinafter, with reference to the drawings, the same elements or similar elements having the same function are denoted by the same reference numerals, and redundant description will be omitted.

Fluid Pumping System

The fluid pumping system 1 shown in FIG. 1 is a pumping system for increasing the pressure of a water supply line to a water supply consumer facility such as a faucet or a shower head. The fluid pumping system 1 includes electrical pumping devices 10, check valves 40, a pressure sensor 30, and a power conversion system 20.

The pumping device 10 (electrical machine) pumps water (fluid) by electric power. For example, the pumping device 10 includes a pump 11 and a motor 12. The pump 11 has a suction port 11*a* connected to the primary side water supply pipe 91 and a discharge port 11*b* connected to the secondary side water supply pipe 92. The "primary side" means the upstream side of the fluid pumping system 1, and the "secondary side" means the downstream side of the fluid pumping system 1. The pump 11 is configured to pump fluid from the primary side water supply pipe 91 (primary line) to the secondary side water supply pipe 92 (secondary line). The pump 11 incorporates a rotary pumping body such as an impeller or a reciprocating pumping body such as a diaphragm, and pumps water from the suction port 11*a* to the discharge port 11*b* by rotation of the rotary pumping body or reciprocation of the reciprocating pumping body. This pumps water from the primary side water supply pipe 91 to the secondary side water supply pipe 92.

The motor 12 converts electric power into motive power to drive the pump 11. For example, the motor 12 is a synchronous motor or an induction motor that converts AC power into rotational torque. The object to be pumped by the pumping device 10 may be a liquid other than water. The object to be pumped by the pumping device 10 is not necessarily limited to a liquid. For example, the pumping device 10 may include a ventilator (for example, a fan or a blower) for pumping gas instead of the pump 11 for liquid pumping. In FIG. 1, two pumping devices 10 are illustrated for convenience, but the number of pumping devices 10 is not limited thereto. The fluid pumping system 1 may comprise three or more pumping devices 10.

The check valves 40 are interposed between the suction ports 11*a* and the secondary side water supply pipe 92 to prevent backflow of water from the secondary side water supply pipe 92 to the primary side water supply pipe 91. The pressure sensor 30 detects the secondary side pressure of the fluid pumping system 1. For example, the pressure sensor 30 is connected to the secondary side water supply pipe 92 on the downstream side of the check valves 40.

The power conversion system 20 causes at least one of the pumping devices 10 to pump water from the primary side water supply pipe 91 to the secondary side water supply pipe 92 as the pressure detected by the pressure sensor 30 decreases. The power conversion system 20 is configured to estimate deterioration levels of the pumping devices 10 based on information about driving forces of the one pumping devices 10, select a pumping device 10 from the pumping devices 10 based on the estimated deterioration levels, and control the selected pumping device 10 to pump water.

For example, the power conversion system 20 includes a plurality of power conversion apparatuses 100 and a controller 200. The plurality of power conversion apparatuses 100 convert power of a power source (e.g., a power system or a battery) into driving power (e.g., AC power) and supply the driving power to the pumping devices 10, respectively. Hereinafter, in the description of each power conversion apparatus 100, the pumping device 10 to which power is supplied by the power conversion apparatus 100 is referred to as a "corresponding pumping device 10".

The power conversion apparatus 100 is configured to output a driving current to the motor 12 of the corresponding pumping device 10 to operate the corresponding pumping device 10 when the corresponding pumping device 10 is selected from the pumping devices 10 based on the deterioration levels of the pumping devices 10, and estimate the deterioration level of the corresponding pumping device 10 based on information about a driving force of the corresponding pumping device 10 (e.g., a driving force applied to the pump 11 by the motor 12). Since each of the plurality of power conversion apparatuses 100 is configured to estimate the deterioration level of the corresponding pumping device 10, the plurality of power conversion apparatuses 100 comprise circuitry configured to estimate deterioration levels of pumping devices 10.

The controller 200 selects at least one pumping device 10 from the pumping devices 10 as the pressure detected by the pressure sensor 30 decreases, and outputs a driving current from the power conversion apparatus 100 corresponding to the at least one pumping device 10 to the motor 12 so that water is pumped by the selected at least one pumping device 10. The controller 200 is configured to select the at least one pumping device 10 from the pumping devices 10 based on the deterioration level estimated by the at least one power conversion apparatus 100. For example, the controller 200 is configured to select a pumping device 1 from the pumping devices 10 based on a comparison of deterioration levels estimated by the plurality of power conversion devices 100.

Figure 2:
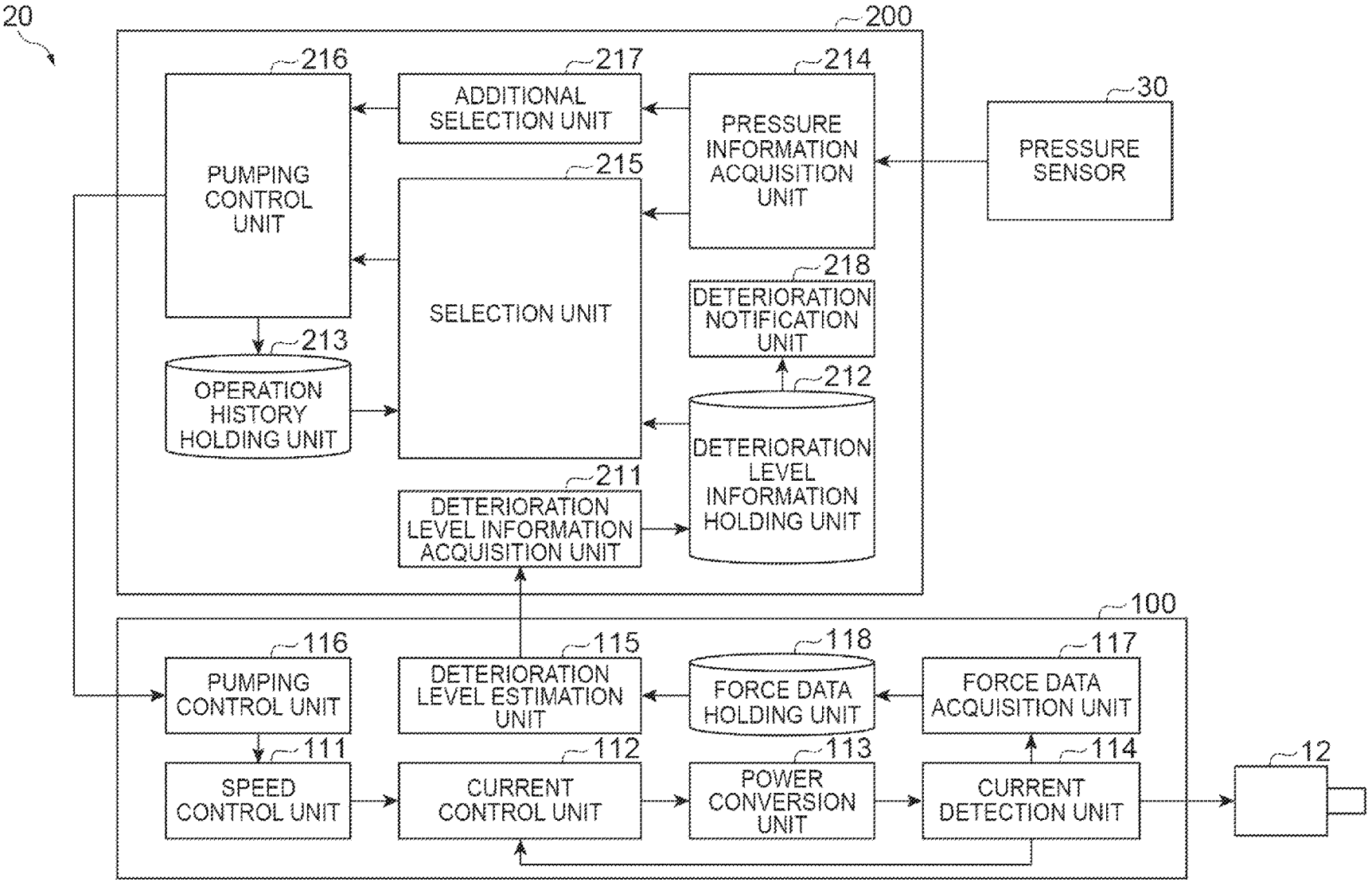
FIG. 2 is a block diagram illustrating a functional configuration of a power conversion system.

FIG. 2 is a block diagram illustrating a functional configuration of the power conversion system 20. The power conversion apparatus 100 includes a power conversion unit 113, a speed control unit 111, a current control unit 112, a current detection unit 114, a deterioration level estimation unit 115, a pumping control unit 116, a force data acquisition unit 117, and a force data holding unit 118 as functional modules.

The power conversion unit 113 outputs driving power to the motor 12. For example, the power conversion unit 113 outputs an AC voltage having a frequency corresponding to the operation speed of the motor 12 to the motor 12 at a voltage amplitude corresponding to the voltage command. For example, the power conversion unit 113 generates the AC voltage by pulse width modulation (PWM). The power conversion unit 113 may be an inverter that converts DC power of a DC bus into AC power to generate drive power, or may be a matrix converter that performs bidirectional power conversion between AC power on the AC power supply side and AC power on the motor 12 side.

The speed control unit 111 causes the speed control unit 111 to output the AC voltage to the motor 12 so that the operation speed of the motor 12 follows the target speed. For example, the speed control unit 111 calculates a current command (torque command) for reducing the deviation between the target speed and the operating speed of the motor 12.

The current control unit 112 calculates a voltage command for reducing a deviation between the current command calculated by the speed control unit 111 and the driving current being output to the motor 12, and outputs the voltage command to the power conversion unit 113. Accordingly, the power conversion unit 113 outputs, to the motor 12, an AC voltage for causing the operation speed of the motor 12 to follow the target speed.

The current detection unit 114 detects the driving current output from the power conversion unit 113 to the motor 12 and feeds back the driving current to the current control unit 112. The speed control unit 111, the current control unit 112, the power conversion unit 113, and the current detection unit 114 repeat the above-described processing at a predetermined control cycle.

The force data acquisition unit 117 acquires information (hereinafter, force data) on a driving force of the corresponding pumping device 10 for each control period. The information on the driving force (hereinafter, force data) may be any information as long as it is correlated with the driving force to such an extent that the magnitude of the driving force can be grasped based on the information. For example, since the magnitude of the driving current is correlated (substantially proportional) to the magnitude of the driving force, the magnitude of the driving current corresponds to the force data. Since the magnitude of the driving current corresponds to the force data, the force data acquisition unit 117 may acquire the force data associated with the driving current. The force data acquisition unit 117 may acquire the force data includes current information indicating the driving current of the corresponding pumping device 10. For example, the force data acquisition unit 117 acquires the magnitude of the driving current detected by the current detection unit 114 as force data. The force data acquisition unit 117 may acquire the magnitude of the current command calculated by the speed control unit 111 as force data. When the pumping device 10 includes a driving force sensor (e.g., a torque sensor), the force data acquisition unit 117 may acquire a detected value of the torque sensor as force data. The force data holding unit 118 stores the force data acquired by the force data acquisition unit 117 in time series.

The deterioration level estimation unit 115 estimates the deterioration level of the corresponding pumping device 10 based on the force data. The deterioration level estimation unit 115 calculates an amplitude index value corresponding to the amplitude of the oscillation of the force data as an example of estimating the deterioration level. Here, "corresponding" means a correlation in which the amplitude index value increases or decreases in accordance with an increase or decrease in amplitude. The amplitude index value may be any value as long as it "corresponds" to the amplitude.

In the pumping device 10, the amplitude of the oscillation of the force data tends to increase as the deterioration level of the power transmission system from the motor 12 to the pump 11 increases. Therefore, calculating the amplitude index value corresponds to estimating the deterioration level of the pumping device 10. Examples of the deterioration of the power transmission system include deterioration of a bearing of a torque transmission shaft.

For example, the deterioration level estimation unit 115 derives the amplitude of the oscillation of the force data as the amplitude index value based on a plurality of force data acquired from a predetermined period before the acquisition time of the force data to the acquisition time. The amplitude may be a width from a negative peak to a positive peak, or may be a half of a width from a negative peak to a positive peak. The oscillation is an oscillation in a steady operation of the pumping device 10. The steady operation means an operation state in which water is filled in the pump 11 and the driving speed of the pump 11 substantially coincides with the target speed. Substantially coincident means that the difference between the driving speed and the target speed is within a negligible error range. The deterioration level estimation unit 115 may calculate the difference between the maximum value and the minimum value of the force data within a predetermined period as the amplitude, or may calculate the amplitude by fast Fourier transform (FFT) or the like. The deterioration level estimation unit 115 may calculate the amplitude of a predetermined frequency component by FFT, or may calculate an average value, a maximum value, or the like of the amplitude in a frequency component of a predetermined band.

The deterioration level estimation unit 115 may calculate, as the amplitude index value, the difference between the force data and the trend value of the force data based on the past force data acquired from a predetermined period before the acquisition time of the force data to the acquisition time. For example, the deterioration level estimation unit 115 removes a DC component from the past force data as necessary with respect to the latest force data, and further performs low-pass type filtering to calculate the trend value.

As an example of the low-pass type filtering, there is a finite impulse response type filtering. When first order filtering of the finite impulse response method is used, the trend value is derived by the following equation.

$$Y=A\cdot X[k]+(1-A)\cdot X[k-1] \quad (1)$$

Y: trend value

X[k]: latest force data

X[k−1]: previously acquired force data

A: filter coefficient

When second order filtering of the finite impulse response method is used, the trend value is derived by the following equation.

$$Y=A\cdot X[k]+B\cdot X[k-1]+(1-A-B)\cdot X[k-2] \quad (2)$$

Y: trend value

X[k]: latest force data

X[k−1]: previously acquired force data

X[k−2]: acquired force data two times before

A and B: filter coefficients.

The deterioration level estimation unit 115 does not necessarily use the latest force data for calculating the trend value, and may calculate the trend value based on the past force data. For example, X[k] may be force data acquired several times (for example, one time) before the latest.

When the corresponding pumping device 10 is selected from the pumping devices 10 based on the deterioration level estimated by the deterioration level estimation unit 115, the pumping control unit 116 controls the power conversion unit 113 to output a driving current to the motor 12 so as to operate the corresponding pumping device 10. For example, when the corresponding pumping device 10 is selected, the pumping control unit 116 causes the speed control unit 111 to start control (control for causing the operating speed of the motor 12 to follow the target speed).

The controller 200 includes, as functional modules, a deterioration level information acquisition unit 211, a deterioration level information holding unit 212, an operation history holding unit 213, a pressure information acquisition unit 214, a selection unit 215, and a pumping control unit 216. The deterioration level information acquisition unit 211 acquires the estimation result of the deterioration level by the deterioration level estimation unit 115 of each power conversion apparatus 100. The deterioration level information holding unit 212 stores the estimation result of the deterioration level acquired by the deterioration level information acquisition unit 211 for each power conversion apparatus 100. The operation history holding unit 213 stores operation history information of each pumping device 10. The operation history information includes, for example, a pumping start time and a pumping stop time of water by the pumping device 10.

The pressure information acquisition unit 214 acquires information on the secondary side pressure (a pressure in the secondary line) in the pumping devices 10 (for example, a value detected by the pressure sensor 30). The selection unit 215 selects at least one pumping device 10 from the pumping devices 10 in response to the secondary side pressure falling below a predetermined lower limit value (hereinafter, pressure lower limit value). For example, the selection unit 215 may select the pumping device 10 in response to determining that the secondary side pressure is lower than the lower limit value. Hereinafter, pumping device 10 selected by selection unit 215 is referred to as "pumping device 10 for normal operation".

The selection unit 215 selects the pumping device 10 for normal operation based on the deterioration levels stored in the deterioration level information holding unit 212. The pumping devices 10 may include a first pumping device and a second pumping device 10, and the selection unit 215 may be configured to select the first pumping device 10 as the pumping device 10 for normal operation, in response to determining that a deterioration level of the first pumping device is lower than a deterioration level of the second pumping device 10. For example, the selection unit 215 selects the pumping device 10 for normal operation to make the operation period of the pumping device 10 having a higher deterioration level shorter than the operation period of the pumping device 10 having a lower deterioration level. For example, the selection unit 215 selects the pumping device 10 having the lowest deterioration level from the pumping devices 10.

The selection unit 215 may select the pumping device 10 for normal operation based on a predetermined selection criterion and the deterioration level stored in the deterioration level information holding unit 212. For example, the selection unit 215 may select the pumping device 10 for normal operation based on a first selection criterion based on the deterioration level and a second selection criterion determined separately from the first selection criterion. For example, the selection unit 215 may select the pumping device 10 for normal operation based on the first selection criterion used to compare the deterioration levels, and based on the second selection criterion different from the first selection criterion. For example, the first selection criterion is set to select a pumping device 10 having a lower deterioration level over a pumping device 10 having a higher deterioration level. For example, the first selection criterion may be predetermined so that the first pumping device 10 is selected if a deterioration level of the first pumping device 10 is lower than a deterioration level of the second pumping device.

The second selection criterion may be used to compare cumulative operation periods of the pumping devices 10. For example, the second selection criterion is set to select the pumping device 10 having a shorter cumulative operation period over the pumping device 10 having a longer cumulative operation period. For example, the second selection criterion may be predetermined so that the first pumping device 10 is selected if a cumulative operation period of the first pumping device 10 is shorter than a cumulative operation period of the second pumping device 10. The cumulative operation period is substantially correlated with the cumulative operation times. Therefore, selecting the pumping device 10 with a shorter cumulative operation period over the pumping device 10 with a longer cumulative operation period includes selecting the pumping device 10 with fewer cumulative operation times over the pumping device 10 with more cumulative operation times.

The first selection criterion may prioritize a selection of the pumping device 10 in response to determining that the pumping device 10 has a lower deterioration level compared to one or more of the pumping devices 10, and the second selection criterion may prioritize a selection of the pumping device 10 in response to determining that the pumping device 10 has a shorter cumulative operation period compared to the one or more pumping devices 10. The selection unit 215 may calculate priority levels of the pumping devices 10 based on a combination of the first selection criterion and the second selection criterion and select the pumping device 10 in response to determining that the pumping device 10 has a higher priority level compared to the one or more pumping devices 10. For example, the selection unit 215 derives the priority of each of the pumping devices 10 based on both the first selection criterion and the second selection criterion, and selects the pumping device 10 having the highest priority. For example, the selection unit 215 derives the priority based on a function, a table, or the like defined such that the priority of the pumping device 10 having a lower deterioration level is higher than the priority of the pumping device 10 having a higher deterioration level when there is no difference in the cumulative operation period, and the priority of the pumping device 10 having a short cumulative operation period is higher than the priority of the pumping device 10 having a long cumulative operation period when there is no difference in the deterioration level.

The selection unit 215 may select the pumping device 10 for normal operation based on the predetermined selection criterion, and select the pumping device 10 for normal operation based on the deterioration level when the deterioration level of any of the pumping devices 10 exceeds a predetermined threshold value (hereinafter, referred to as a reference change over threshold value). For example, the selection unit 215 may calculate priority levels of the pumping devices 10 based on the second selection criterion if each of the deterioration levels is lower than a first threshold value, calculate the priority levels based on the first selection criterion if at least one of the deterioration levels is higher than the first threshold value; and select the pumping device in response to determining that the pumping device 10 has a higher priority level compared to the one or more pumping devices 10. For example, the selection unit 215 may select the pumping device 10 for normal operation based on the second selection criterion when the maximum value of the deterioration level in the pumping devices 10 (hereinafter, the maximum value of the deterioration level) is below the reference change over threshold value, and select the pumping device 10 for normal operation based on the first selection criterion when the maximum value of the deterioration level is above the reference change over threshold value.

The selection unit 215 may change the weight of the first selection criterion with respect to the second selection criterion as the deterioration level increases. For example, the selection unit 215 may increase a weight of the first selection criterion, in calculating the priority levels, in response to an increase of one of the deterioration levels. For example, the selection unit 215 may calculate the priority levels based on a combination of the first selection criterion and the second selection criterion if each of the deterioration levels is lower than a second threshold value that is higher than the first threshold value and at least one of the deterioration levels is higher than the first threshold value; and calculate the priority levels based on the first selection criterion if at least one of the deterioration levels is higher than the second threshold value. For example, the selection unit 215 may change the weight of the first selection criterion with respect to the second selection criterion based on the relationship between the plurality of levels of reference change over threshold values and the maximum value of the deterioration level. For example, the selection unit 215 may select the pumping device 10 for normal operation based only on the second selection criterion when the maximum value of the deterioration level is below the minimum reference change over threshold value, increase the weight of the first selection criterion for the second selection criterion whenever the maximum value of the deterioration level exceeds the reference change over threshold value, and select the pumping device 10 for normal operation based only on the first selection criterion when the maximum value of the deterioration level exceeds the maximum reference change over threshold value. The selection unit 215 deselects the pumping device 10 for normal operation in response to the secondary side pressure exceeding a predetermined upper limit value (hereinafter, pressure upper limit value). For example, the selection unit 215 may deselect the pumping device 10 in response to determining that the secondary side pressure is higher than the upper limit value.

When the pumping device 10 for normal operation is selected, the pumping control unit 216 outputs a driving start command to the power conversion apparatus 100 corresponding to the pumping device 10 for normal operation. Accordingly, the pumping control unit 116 of the power conversion apparatus 100 starts pumping water by the pumping device 10 for normal operation. That is, the pumping control unit 216 controls the pumping device 10 selected by the selection unit 215 to pump water.

When the selection of the pumping device 10 for normal operation is released, the pumping control unit 216 outputs a driving stop command to the power conversion apparatus 100 corresponding to the pumping device 10 for normal operation. Accordingly, the pumping control unit 116 of the power conversion apparatus 100 stops the pumping of water by the pumping device 10 for normal operation.

The controller 200 may be configured to cause at least one pumping device 10 that is not selected by the selection unit 215 to also pump water when a secondary side pressure of the pumping device 10 for normal operation (e.g., a detected value by the pressure sensor 30) is insufficient. For example, the controller 200 further includes an additional selection unit 217.

The additional selection unit is configured to select an additional pumping device 10 from the pumping devices 10 in response to determining that the secondary side pressure is lower than a target value equal to or higher than the lower limit value while the pumping device 10 is controlled to pump fluid from the primary side water supply pipe 91 to the secondary side water supply pipe 92. For example, the additional selection unit 217 selects at least one pumping device 10 not selected by the selection unit 215 from the pumping devices 10 when the secondary side pressure in the pumping device 10 for normal operation is insufficient. Hereinafter, the pumping device 10 selected by the additional selection unit 217 is referred to as "pumping device 10 for additional operation". For example, the additional selection unit 217 selects the pumping device 10 for additional operation when the detected value by the pressure sensor 30 is below the target value (hereinafter, referred to as an additional threshold value) although the pumping device 10 for normal operation is pumping water. The additional threshold value may be any value that is greater than or equal to the pressure lower limit value and less than the pressure upper limit value. The additional selection unit 217 cancels the selection of the pumping device 10 for additional operation in response to the secondary side pressure exceeding the pressure upper limit value.

When the additional selection unit 217 selects the pumping device 10 for additional operation, the pumping control unit 216 controls both the pumping device 10 for normal operation and the pumping device 10 for additional operation to concurrently pump fluid from the primary side water supply pipe 91 to the secondary side water supply pipe 92. For example, the pumping control unit 216 outputs a driving start command to the power conversion apparatus 100 corresponding to the pumping device 10 for additional operation. Accordingly, the pumping control unit 116 of the power conversion apparatus 100 starts controlling the pumping device 10 for additional operation to pump water. That is, the pumping control unit 216 controls the pumping device 10 for additional operation to pump water while the pumping control unit 116 for normal operation controls the pumping device 10 for normal operation to pump water. When the selection of the pumping device 10 for additional operation is released, the pumping control unit 216 outputs a driving stop command to the power conversion apparatus 100 corresponding to the pumping device 10 for additional operation. Accordingly, the pumping control unit 116 of the power conversion apparatus 100 stops the pumping of water by the pumping device 10 for additional operation.

The pumping device 10 for additional operation may have a higher deterioration level compared to the pumping device 10 for normal operation. For example, the additional selection unit 217 may be configured to select a pumping device 10 even if the pumping device 10 has a higher deterioration level compared to the pumping device 10 for normal operation. For example, when the selection unit 215 does not select the pumping device 10 whose deterioration level exceeds a predetermined threshold value, the additional selection unit 217 may select the pumping device 10 whose deterioration level exceeds the threshold value. For example, the additional selection unit 217 may be configured to select a pumping device 10 even if a deterioration level of the pumping device 10 exceeds the maximum reference change over threshold value.

The controller 200 may be further configured to notify a user of the deterioration level of the at least one pumping device 10. For example, the controller 200 further includes a deterioration notification unit 218. The deterioration notification unit 218 notifies the user that the deterioration level of at least one pumping device 10 exceeds a predetermined threshold value (hereinafter, referred to as a notification threshold value) through a display device. In some examples, the deterioration notification unit 218 notifies the user through the display device that the maximum value of the deterioration level exceeds the notification threshold value. Examples of the display device include a liquid crystal monitor and an alarm lamp. The alert threshold value may be higher than the reference change over threshold value described above.

The deterioration notification unit 218 may be configured to notify the user of a change in the relationship between the alert threshold value and the maximum value of the deterioration level in multiple stages. For example, the deterioration notification unit 218 may be configured to notify the user of the increase in the deterioration level each time the deterioration level being increased exceeds the alert threshold value. The increase in the deterioration level can be notified by a change in the display content on the liquid crystal monitor, a change in the color of the alarm lamp, or the like.

The deterioration notification unit may be configured to further notify in which pumping device 10 the deterioration level exceeds the alert threshold value. In which pumping device 10 the deterioration level exceeds the alert threshold value can be notified by displaying identification information of the pumping device 10 exceeding the alert threshold value on the liquid crystal monitor, for example. In addition, in which pumping device 10 the deterioration level exceeds the alert threshold value can be notified by which alarm lamp provided for each pumping device 10 is turned on.

Figure 3:
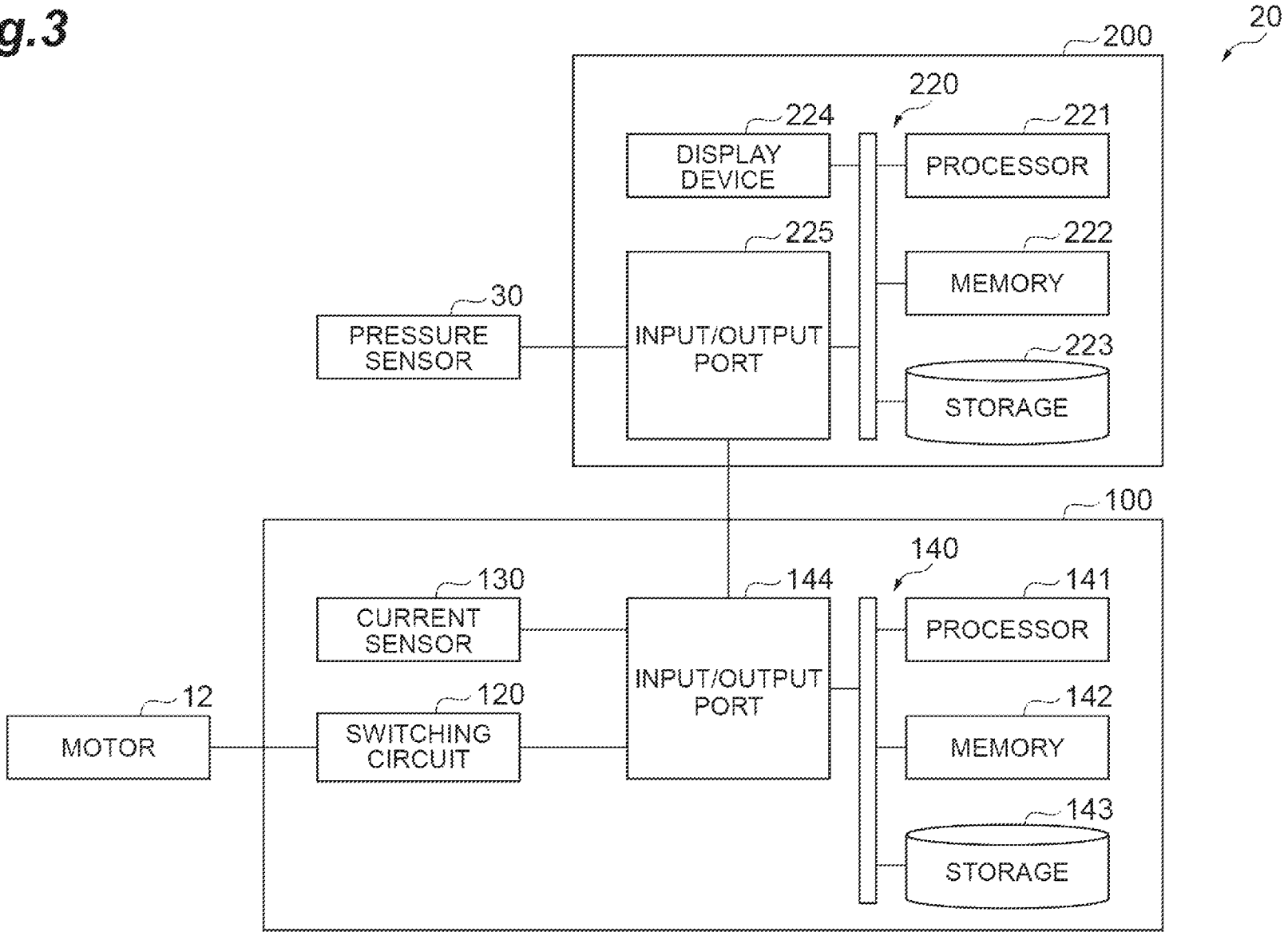
FIG. 3 is a block diagram illustrating a hardware configuration of the power conversion system.

FIG. 3 is a block diagram illustrating a hardware configuration of the power conversion system 20. As shown in FIG. 3, the power conversion apparatus 100 includes a switching circuit 120, a current sensor 130, and control circuitry 140.

The switching circuit 120 operates in accordance with a command from the control circuitry 140 (for example, an electric signal from the input/output port 144), and functions as the power conversion unit 113. For example, the switching circuit 120 outputs the driving power to the motor 12 by switching on and off a plurality of switching elements in accordance with an electric signal (for example, a gate signal) from the input/output port 144. The switching element is, for example, a power metal oxide semiconductor field effect transistor (MOSFET) or an insulated gate bipolar transistor (IGBT). The current sensor 130 operates in accordance with a command from the control circuitry 140 (for example, an electric signal from the input/output port 144), and functions as the above-described current detection unit 114. The current sensor 130 detects the output current from the switching circuit 120 to the motor 12.

The control circuitry 140 includes one or more processors 141, memory 142, storage 143, and an input/output port 144. The storage 143 includes a computer-readable storage medium such as a nonvolatile semiconductor memory. The storage 143 stores a program for causing the power conversion apparatus 100 to output a driving current to the motor 12 of the corresponding pumping device 10 so as to operate the corresponding pumping device 10 when the corresponding pumping device 10 is selected from the pumping devices 10 based on the deterioration level of the pumping device 12, and to estimate the deterioration level of the corresponding pumping device 10 based on information on the driving force of the corresponding pumping device 10 (e.g., the driving force applied to the pump 11 by the motor 12). For example, the storage 143 stores a program for configuring the functional modules of the power conversion apparatus 100.

The memory 142 temporarily stores a program loaded from the storage medium of the storage 143 and an operation result by the processor 141. The processor 141 executes the program in cooperation with the memory 142 to configure each functional module of the power conversion apparatus 100. The input/output port 144 has a terminal block of an input power supply, and performs input/output of an electric signal between the switching circuit 120, the current sensor 130, and the controller 200 according to a command from the processor 141.

The controller 200 includes circuitry 220. The circuitry 220 includes one or more processors 221, a memory 222, a storage 223, a display device 224, and an input/output port 225. The storage 223 includes a computer-readable storage medium such as a nonvolatile semiconductor memory. The storage 223 stores a program for causing the controller 200 to select at least one pumping device 10 from the pumping devices 10 based on the deterioration level estimated by the at least one power conversion apparatus 100, and output a driving current from the power conversion apparatus 100 corresponding to the at least one pumping device 10 to the motor 12 so that water is pumped by the selected at least one pumping device 10. For example, the storage 223 stores a program for configuring the functional modules of the controller 200 described above.

The storage 143 of the power conversion apparatus 100 and the storage 223 of the controller 200 correspond to the storage of the power conversion system 20, and the storage stores a program for causing the power conversion system 20 to estimate the deterioration level of one pumping device 10 based on the information on the driving force of the one pumping device 10, select at least one pumping device 10 from the pumping devices 10 based on the estimated deterioration level, and control the selected at least one pumping device 10 to pump water.

The memory 222 temporarily stores a program loaded from the storage 223, an operation result by the processor 221, and the like. The processor 221 executes the application in cooperation with the memory 222. The display device 224 includes, for example, a liquid crystal monitor, an alarm lamp, and the like, and is used for displaying information to the user. The input/output port 225 inputs and outputs an electric signal between the pressure sensor 30 and the power conversion apparatus 100 in accordance with a command from the processor 221.

The functions of the control circuitry 140 and the circuitry 220 are not necessarily configured by programs. For example, at least a part of the functions of the control circuitry 140 and the circuitry 220 may be configured by dedicated logic circuitry or an application specific integrated circuit (ASIC) in which the dedicated logic circuitry is integrated.

Figure 4:
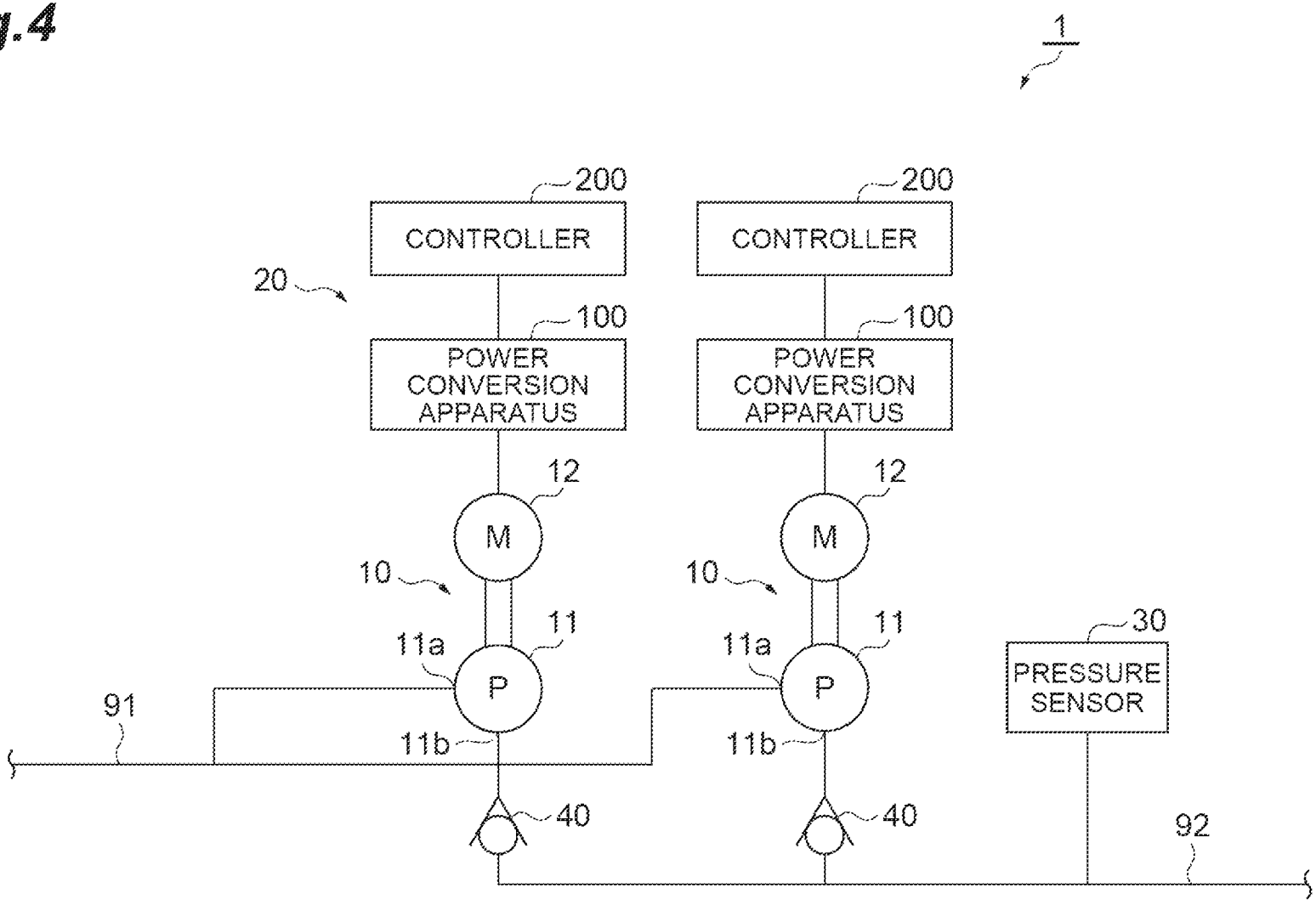
FIG. 4 is a schematic view illustrating a modification of the fluid pumping system.
Figure 5:
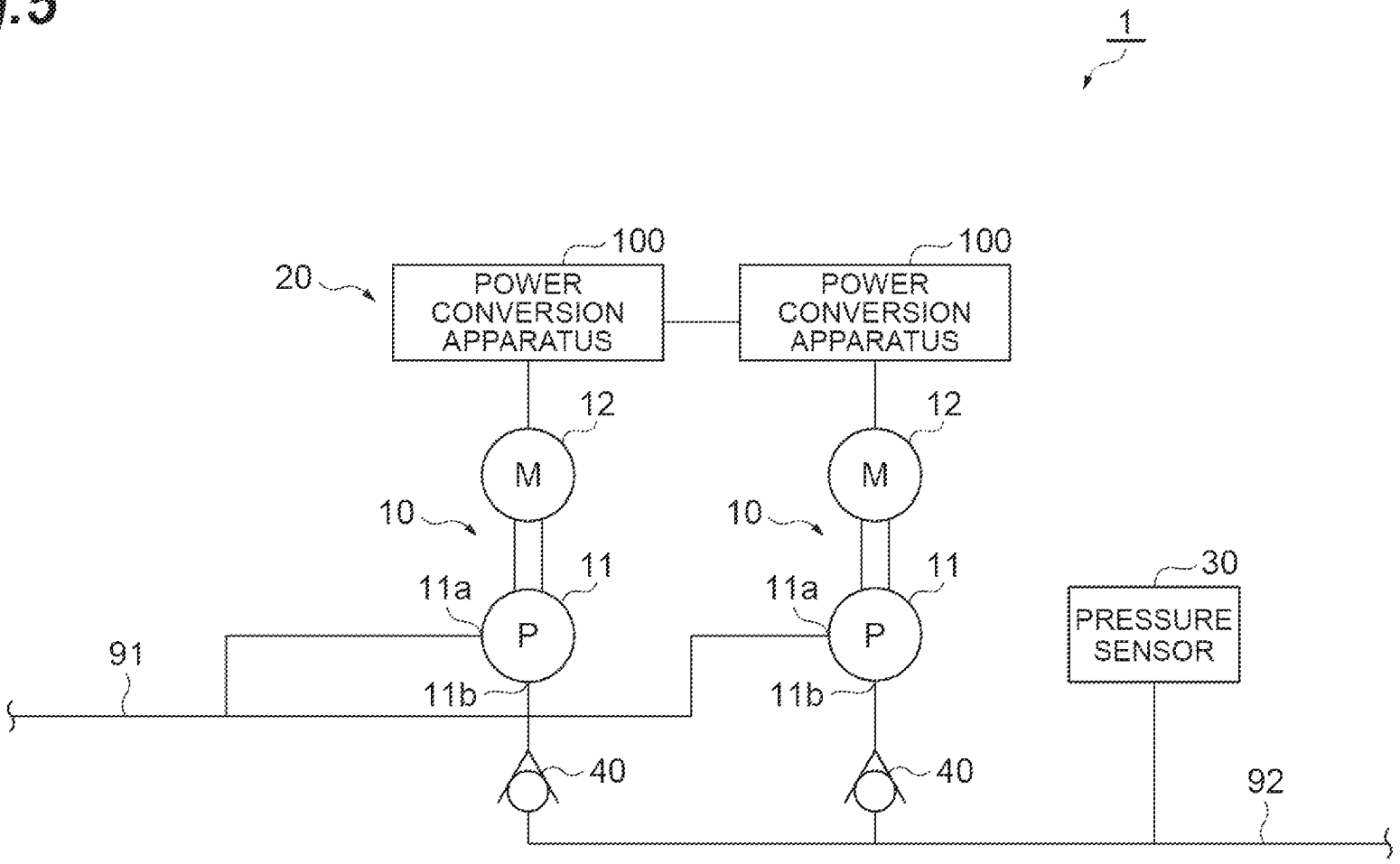
FIG. 5 is a schematic view showing another modification of the fluid pumping system.

The configuration of the power conversion system 20 described above is merely an example, and can be changed. For example, in the above example, one controller 200 is provided for a plurality of power conversion apparatuses 100, but the present configuration is not limited thereto, and a plurality of controllers 200 may be provided for a plurality of power conversion apparatuses 100, respectively (see FIG. 4). In this case, at least one of the plurality of controllers 200 can constitute a functional module of the controller 200 described above. Further, the functional module of the controller 200 may be configured by any of the plurality of power conversion apparatuses 100. In this case, the controller 200 may be omitted (see FIG. 5).

Fluid Pumping Method

Next, as an example of the fluid pumping method, an example control procedure of the pumping devices 10 executed by the power conversion system 20 will be described. The control procedure includes: estimating a deterioration level of one of the pumping devices 10 based on information about a driving force of the one pumping device 10, selecting at least one pumping device 10 from the pumping devices 10 based on the estimated deterioration level, and pumping water by the selected at least one pumping device 10.

Figure 6:
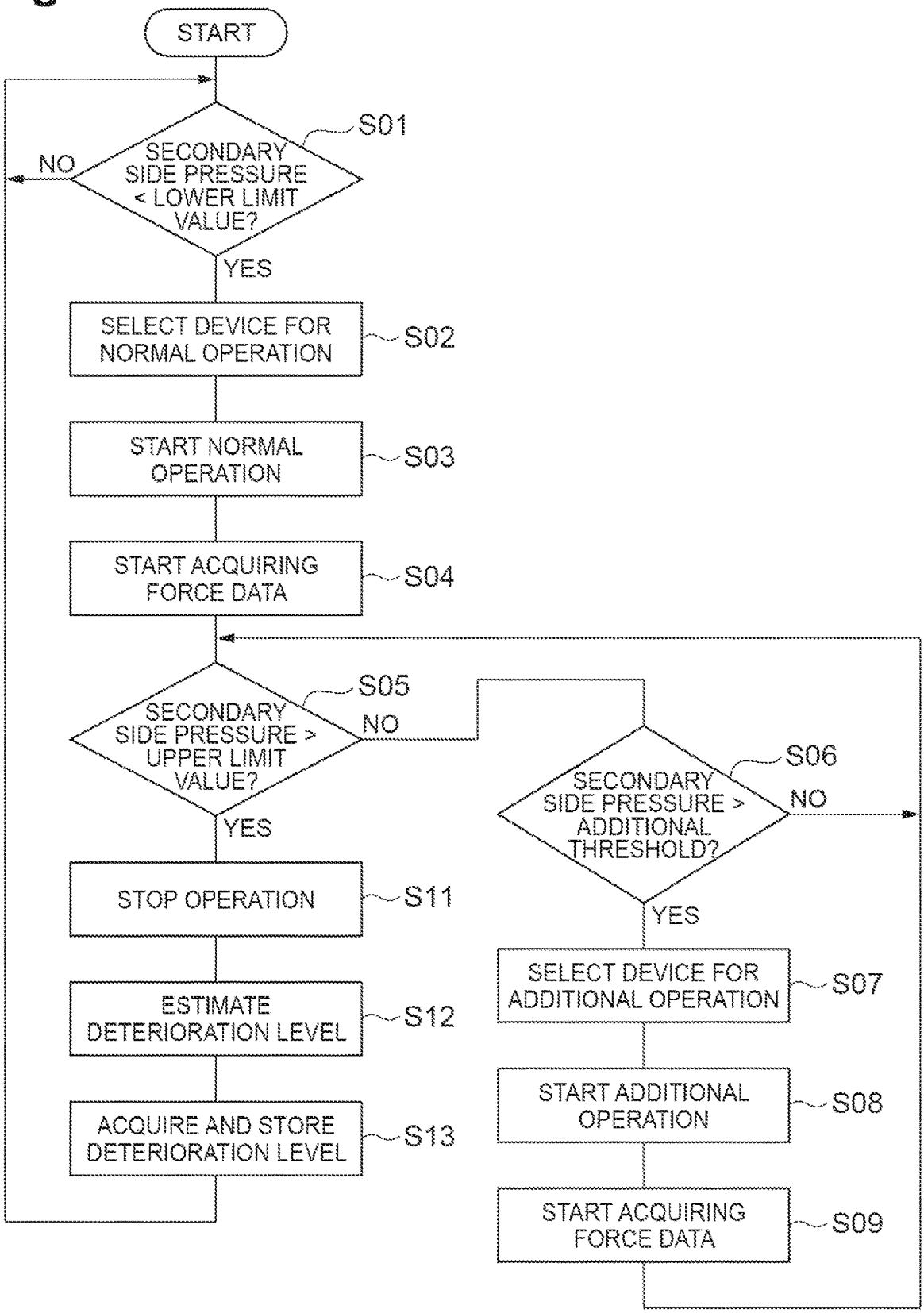
FIG. 6 is a flowchart illustrating a control procedure of pumping devices.

FIG. 6 is a flowchart illustrating a control procedure of the pumping devices 10. As shown in FIG. 6, the power conversion system 20 first executes operation S01. In operation S01, the pressure information acquisition unit 214 acquires the detected value by the pressure sensor 30 as the information of the secondary side pressure, and the selection unit 215 checks whether the detected value is below the pressure lower limit value. When it is determined that the detected value by the pressure sensor 30 is not lower than the pressure lower limit value, the power conversion system 20 executes operation S01 again. Thereafter, operation S01 is repeated until the detected value by the pressure sensor 30 falls below the pressure lower limit value.

When it is determined that the detected value by the pressure sensor 30 is lower than the pressure lower limit value, the power conversion system 20 executes operations S02, S03, S04, and S05. In operation S02, the selection unit 215 selects the pumping device 10 for normal operation based on the deterioration level stored in the deterioration level information holding unit 212. In operation S03, the pumping control unit 216 outputs a driving start command to the power conversion apparatus 100 corresponding to the pumping device 10 for normal operation (hereinafter, power conversion apparatus 100 for normal operation). Accordingly, the pumping control unit 116 of the power conversion apparatus 100 starts the pumping of water by the pumping device 10 for normal operation. In operation S04, the force data acquisition unit 117 of the power conversion apparatus 100 for normal operation starts acquiring force data.

In operation S05, the pressure information acquisition unit 214 acquires the detected value by the pressure sensor 30 as the information of the secondary side pressure, and the selection unit 215 checks whether the detected value exceeds the pressure upper limit value. If it is determined in operation S05 that the detected value does not exceed the pressure upper limit value, the power conversion system 20 executes operation S06. In operation S06, the additional selection unit 217 checks whether the value detected by the pressure sensor 30 is below the additional threshold value.

If it is determined in operation S06 that the detected value is below the additional threshold value, the power conversion system 20 executes operations S07, S08, and S09. In operation S07, the additional selection unit 217 selects the pumping device 10 for additional operation from the pumping devices 10. In operation S08, the pumping control unit 216 outputs a driving start command to the power conversion apparatus 100 corresponding to the pumping device 10 for additional operation (hereinafter referred to as the power conversion apparatus 100 for additional operation). Accordingly, the pumping control unit 116 of the power conversion apparatus 100 starts pumping water by the pumping device 10 for additional operation. In operation S09, the force data acquisition unit 117 of the power conversion apparatus 100 for additional operation starts acquiring force data. Thereafter, the power conversion system 20 returns the process to operation S05.

If it is determined in operation S06 that the detected value is not below the additional threshold value, the power conversion system 20 returns the process to operation S05 without executing operations S07, S08, and S09. Thereafter, until the detected value by the pressure sensor 30 exceeds the pressure upper limit value, water pumping by the pumping device 10 for normal operation is continued, and water pumping by the pumping device 10 for additional operation is also continued as necessary.

If it is determined in operation S05 that the detected value exceeds the pressure upper limit value, the power conversion system 20 executes operation S11. In operation S11, the selection unit 215 cancels the selection of the pumping device 10 for normal operation. Accordingly, the pumping control unit 116 of the power conversion apparatus 100 for normal operation stops the pumping of water by the pumping device 10 for normal operation. If the pumping device 10 for additional operation is selected, the additional selection unit 217 cancels the selection of the pumping device 10 for additional operation. Accordingly, the pumping control unit 116 of the power conversion apparatus 100 for additional operation stops the pumping of water by the pumping device 10 for additional operation.

Next, the power conversion system 20 executes operations S12 and S13. In operation S12, the deterioration level estimation unit 115 of the power conversion apparatus 100 estimates the deterioration level of the pumping device 10 for normal operation based on the force data stored in the force data holding unit 118 of the power conversion apparatus 100 for normal operation. When the pumping device 10 for additional operation is selected, the deterioration level estimation unit 115 of the power conversion apparatus 100 for additional operation further estimates the deterioration level of the pumping device 10 for additional operation based on the force data stored in the force data holding unit 118 of the power conversion apparatus 100 for additional operation. In operation S13, the deterioration level information acquisition unit 211 acquires the estimation result of the deterioration level by the deterioration level estimation unit 115 of the power conversion apparatus 100 for the normal operation and the additional operation, and stores the estimation result in the deterioration level information holding unit 212. The power conversion system 20 repeats the above processing.

In the above-described procedure, the deterioration level is estimated once after the operation of the pumping device 10 is stopped, but the timing of estimating the deterioration level is not necessarily limited thereto. For example, the estimation of the deterioration level may be repeated during driving. In this case, the pumping device 10 to be operated may be switched during operation in accordance with an increase in the deterioration level.

As described above, the fluid pumping system 1 includes the pumping devices 10 for pumping water, the deterioration level estimation unit 115 configured to estimate a deterioration level of one pumping device 10 based on information about a driving force of the one pumping device 10, the selection unit 215 configured to select at least one pumping device 10 from the pumping devices 10 based on the deterioration level estimated by the deterioration level estimation unit 115, and the pumping control unit 216 configured to control the at least one pumping device selected by the selection unit 215 to pump water.

According to the fluid pumping system 1, since the selection criterion is automatically changed based on the deterioration level, the pumping device 10 having a lower deterioration level may be preferably operated. This makes it possible to suppress the progress of deterioration of the pumping device 10 having a higher deterioration level. Therefore, the frequency of maintenance may be reduced. In addition, suppressing the progress of deterioration of the pumping device 10 having a higher deterioration level can contribute to improvement of operation efficiency, suppression of vibration, suppression of noise, and the like.

The selection unit 215 may be further configured to select at least one pumping device 10 based on the predetermined selection criterion and the deterioration level estimated by the deterioration level estimation unit 115. In this case, at a stage where deterioration of any pumping device 10 has not progressed, the pumping devices 10 may be selectively used according to desired conditions by setting selection criterion.

The selection unit 215 may be further configured to select at least one pumping device 10 based on the deterioration level and selection criterion determined to select the pumping device 10 having a shorter cumulative operation period over the pumping device 10 having a longer cumulative operation period.

The selection unit 215 may be further configured to select at least one pumping device 10 based on the selection criterion, and to select at least one pumping device 10 based on the deterioration level when a deterioration level of any of the pumping devices 10 exceeds a predetermined threshold value.

The selection unit 215 may be further configured to select at least one pumping device 10 to make an operation period of the pumping device 10 having a higher deterioration level shorter than an operation period of the pumping device 10 having a lower deterioration level. In this case, the operation of the pumping device 10 having a lower deterioration level may be prioritized.

The fluid pumping system 1 may further include an additional selection unit 217 configured to select at least one pumping device 10 not selected by the selection unit 215 from the pumping devices 10 when a secondary side pressure of the pumping device 10 selected by the selection unit 215 is insufficient. The pumping control unit 216 may be further configured to control the pumping device 10 selected by the additional selection unit 217 to pump water while controlling the pumping device 10 selected by the selection unit 215 to pump water. In this case, by suppressing the progress of deterioration in the pumping device 10 having a higher deterioration level, the usable period of the pumping device 10 as an additional operation object can be extended. Therefore, in a configuration in which an operation mode not using an additional operation object (hereinafter, referred to as a normal operation mode) and an operation mode using an additional operation object (hereinafter, referred to as a parallel operation mode) are switched, the deterioration progress of the pumping device 10 having a higher deterioration level may be suppressed.

The additional selection unit 217 may be further configured to select the pumping device 10 having a higher deterioration level than the pumping device 10 selected by the selection unit 215. The operation period of the pumping device 10 for additional operation is shorter than the operation period of the pumping device 10 to be operated. Therefore, by allocating the pumping device 10 having a higher deterioration level to the additional operation object, the pumping device 10 may be used while suppressing the progress of deterioration of the pumping device 10 having a higher deterioration level.

The selection unit 215 may be further configured not to select the pumping device 10 having a deterioration level exceeding the predetermined threshold value, and the additional selection unit 217 may be further configured to select the pumping device 10 having the deterioration level exceeding the threshold value. In this case, the progress of deterioration of the pumping device 10 having a higher deterioration level may be suppressed and the pumping device 10 may be used as an additional operation object.

The fluid pumping system 1 may further comprise a deterioration notification unit 218 configured to notify the user that the deterioration level exceeds a predetermined threshold value. In this case, the maintenance timing may be more reliably optimized.

The deterioration notification unit 218 may be further configured to notify which of the pumping devices 10 the deterioration level exceeds the threshold. In this case, the efficiency of the maintenance work may be improved.

The pumping device 10 may be electrical, and the deterioration level estimation unit 115 may be further configured to estimate the deterioration level of the pumping device 10 based on the driving current of the pumping device 10.

Although certain procedures or operations are described herein as being performed sequentially or in a particular order, in some examples one or more of the operations may be performed in a different order, in parallel, simultaneously with each other, or in an overlapping manner. Additionally, in some examples, one or more of the operations may be optionally performed or, in some cases, omitted altogether.

We claim all modifications and variations coming within the spirit and scope of the subject matter claimed herein.

What is claimed is:

1. A control system comprising circuitry configured to:

calculate amplitude index values of electrically powered pumping devices based on driving currents provided to the pumping devices, the amplitude index values indicating amplitudes of oscillations of driving forces for driving the pumping devices;

estimate deterioration levels of the pumping devices based on the calculated amplitude index values;

select a pumping device from the pumping devices based on a comparison of the estimated deterioration levels; and control the selected pumping device to pump fluid.

2. The control system according to claim 1, wherein the pumping devices include a first pumping device and a second pumping device, and wherein the circuitry is further configured to select the first pumping device in response to determining that a deterioration level of the first pumping device is lower than a deterioration level of the second pumping device.

3. The control system according to claim 1, wherein the circuitry is configured to select the pumping device from the pumping devices based on the comparison of the estimated deterioration levels by using a first selection criterion, and based on a comparison of cumulative operation periods of the pumping devices by using a second selection criterion.

4. The control system according to claim 3, wherein the pumping devices include a first pumping device and a second pumping device, wherein the first selection criterion is predetermined so that the first pumping device is selected if a deterioration level of the first pumping device is lower than a deterioration level of the second pumping device, and wherein the second selection criterion is predetermined so that the first pumping device is selected if a cumulative operation period of the first pumping device is shorter than a cumulative operation period of the second pumping device.

5. The control system according to claim 1, wherein each of the pumping devices is configured to pump fluid from a primary line to a secondary line, and wherein the circuitry is further configured to select the pumping device from the pumping devices in response to determining that a pressure in the secondary line is lower than a lower limit value.

6. The control system according to claim 5, wherein the circuitry is further configured to deselect the selected pumping device in response to determining that the pressure in the secondary line is higher than an upper limit value.

7. The control system according to claim 5, wherein the circuitry is further configured to:

select an additional pumping device from the pumping devices in response to determining that the pressure in the secondary line is lower than a target value that is equal to or higher than the lower limit value while the selected pumping device is controlled to pump fluid from the primary line to the secondary line; and control both the selected pumping device and the additional pumping device to concurrently pump fluid from the primary line to the secondary line.

8. The control system according to claim 7, wherein the additional pumping device has a higher deterioration level compared to the selected pumping device.

9. The control system according to claim 1, wherein the circuitry is further configured to notify a user that at least one of the deterioration levels exceeds a notification threshold value.

10. The control system according to claim 9, wherein the circuitry is further configured to notify which of the pumping devices has a deterioration level exceeding the notification threshold value.

11. The control system according to claim 1, further comprising power conversion circuitry configured to output a driving current to each of the pumping devices.

12. A fluid pumping system comprising:

the control system according to claim 1; and the pumping devices configured to be controlled by the control system.

13. A fluid pumping method, comprising:

calculating amplitude index values of electrically powered pumping devices based on driving currents provided to the pumping devices, the amplitude index values indicating amplitudes of oscillations of driving forces for driving the pumping devices;

estimating deterioration levels of the pumping devices based on the calculated amplitude index values;

selecting a pumping device from the pumping devices based on a comparison of the estimated deterioration levels; and controlling the selected pumping device to pump fluid.

14. A non-transitory memory device having instructions stored thereon that, in response to execution by a processing device, cause the processing device to perform operations comprising:

calculating amplitude index values of electrically powered pumping devices based on driving currents provided to the pumping devices, the amplitude index values indicating amplitudes of oscillations of driving forces for driving the pumping devices;

estimating deterioration levels of the electrically powered pumping devices based on the calculated amplitude index values;

selecting a pumping device from the pumping devices based on a comparison of the estimated deterioration levels; and controlling the selected pumping device to pump fluid.

15. The fluid pumping method according to claim 13, wherein each of the pumping devices is configured to pump fluid from a primary line to a secondary line, and wherein the method further comprises deselecting the selected pumping device in response to determining that a pressure in the secondary line is higher than an upper limit value.

* * * * *